United States Patent [19]

Clark

[11] Patent Number: 4,493,479

[45] Date of Patent: Jan. 15, 1985

[54] HOIST DRIVE SAFETY SYSTEM

[75] Inventor: Charles W. Clark, Seattle, Wash.

[73] Assignee: Ederer Incorporated, Seattle, Wash.

[21] Appl. No.: 475,684

[22] Filed: Mar. 14, 1983

Related U.S. Application Data

[63] Continuation of Ser. No. 205,009, Nov. 7, 1980, abandoned.

[51] Int. Cl.[3] ..... B66D 1/48; B66B 1/26

[52] U.S. Cl. ..... 254/274; 188/77 R; 188/134; 188/166; 192/2; 254/267; 254/378

[58] Field of Search ..... 254/267, 274, 275; 188/77 R, 378, 134, 166; 192/2

[56] References Cited

U.S. PATENT DOCUMENTS

| | | | |
|---|---|---|---|
| 2,250,985 | 7/1941 | Benson | 254/275 |
| 2,356,762 | 8/1944 | Kalix | 254/267 |
| 2,950,086 | 8/1960 | Abraham | 254/274 |
| 3,102,434 | 9/1963 | Cramer, Jr. | 254/267 |
| 3,753,552 | 8/1973 | Barron | 254/275 |
| 4,175,727 | 11/1979 | Clarke | 254/274 |
| 4,177,973 | 12/1979 | Miller et al. | 254/276 |

*Primary Examiner*—Billy S. Taylor

*Attorney, Agent, or Firm*—Seed and Berry

[57] ABSTRACT

A hoist having a motor, gear reduction unit, drum, and an emergency brake on the drum or on a drive-coupled element close to the drum. A brake-actuating mechanism is operated in response to a mechanical out-of-sync detector with mechanical inputs directly from the motor shaft and drum shaft or a shaft coupled to the drum. The detector has an output shaft which signals to actuate the brake actuator when there is a variation in the relative angular velocities between the two input shafts to the detector to set the brake. In one embodiment, the output shaft rotation provided from the variation in the relative velocities of the input shafts also provides the force for applying the emergency brake. In another embodiment, the brake is set by a large force spring which is controlled by a trigger mechanism. In still other embodiments, the mechanical detector is driven by an overspeed or speed-sensitive clutch, and/or by an electrically operated clutch.

29 Claims, 9 Drawing Figures

FIG. 5
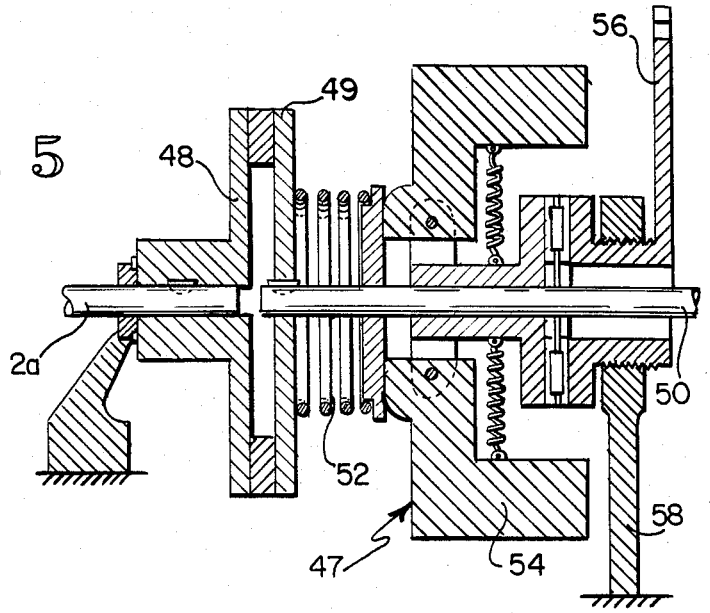
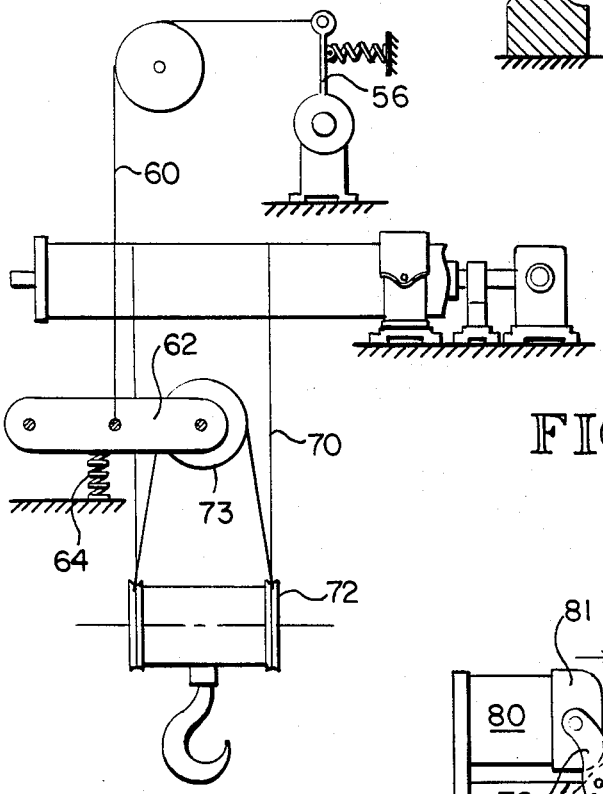
FIG. 6
FIG. 7
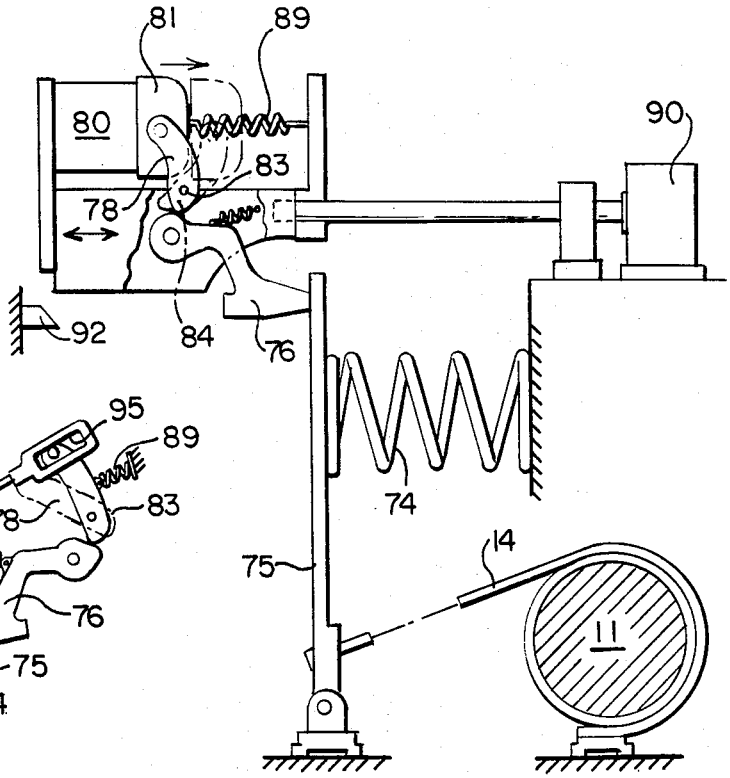
FIG. 8
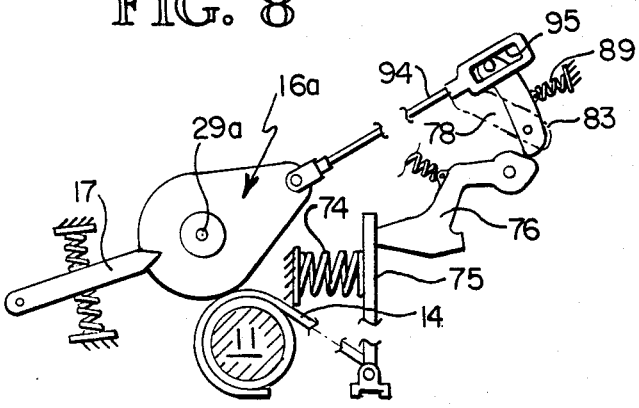

HOIST DRIVE SAFETY SYSTEM

This application is a continuation of U.S. patent application Ser. No. 205,009, filed Nov. 7, 1980, now abandoned.

DESCRIPTION

1. Technical Field

This invention pertains to heavy-duty hoisting equipment and, more particularly, to safety systems for such hoist equipment.

2. Background Art

U.S. Pat. Nos. 4,175,727 and 4,177,973 are directed to safety systems for automatically setting a drum brake or other type of emergency holding device directly on the drum or on a shaft driving or driven by the drum and in close proximity to the drum so that the system makes the hoist essentially single-failure-proof. This means that should a failure occur in any location in the input drive or should there be a load hang-up or two-blocking condition, that this hazard or failure would immediately be detected and set the brake. This type of system is intended to serve as a substitute for the conventional redundant drive systems utilized in critical load cranes.

In U.S. Pat. Nos. 4,175,727 and 4,177,973, various devices were described for detecting the hazard or failure condition and setting the brake. It is one purpose of this invention to provide an improved form of one of these earlier-described detection devices.

One embodiment covered by said earlier patents is an embodiment which uses compressed air to hold the brake open against a spring-applied force, and the detection of the failure or hazard condition electrically or electromechanically releases the air to allow the brake to be applied. In many installations, air supplies and electrical controls for setting valves are not readily available or desirable. Thus, while the earlier patents contemplated improved detectors and brake actuators, this application is also directed to an improved brake setting device.

DISCLOSURE OF THE INVENTION

It is an object of this invention to provide an improved apparatus for detecting a failure or other hazard on a hoisting device.

It is another object of this invention to provide a totally mechanical detector and brake-applying system for a hoisting device.

It is still another object of one form of the invention to provide a mechanical out-of-sync detector which generates its own force for applying the brake in an out-of-sync condition.

Basically, these objects are obtained in their broadest sense by providing a mechanical differential, out-of-sync detector, the output of which is generated when mechanical inputs from the motor shaft and from the drum or related shaft to be monitored change their relative velocities to one another, or when one of the drive line inputs to the detector is otherwise interrupted due to drive line component failure, system overspeed, or loss of electrical power, causing the differential output shaft to rotate via a differential gear set and trigger some form of brake-actuating device to apply the brake.

In one form of the invention, the out-of-sync detector itself provides the force or muscle necessary to apply the brake without intervening air or electrical elements. Since the air and electrical elements are frequently not available or are susceptible to failure themselves in the frequently dusty or dirty environment around a hoisting device, the benefit of a purely mechanical system is very advantageous. This system, in effect, stands alone such that any failure within the crane or any hazard condition, such as two-blocking or load hang-up, will immediately be sensed and directly converted to stopping the motor and setting the emergency brake to grab the drum before it reaches an appreciable dangerous velocity.

In another embodiment, the out-of-sync detector signals a triggering mechanism to release a cocked high-force spring to set the brake.

In a preferred embodiment, the drive train between the motor and the drum is provided with a torque-limiting device for dissipating high-speed kinetic energy of the system in the event of load hang-up, two-blocking or overload. A nulling device is employed in the out-of-sync detector of this embodiment to compensate for minor creep in the torque-limiting device and/or to compensate for variations between the gear reduction units on opposite sides of the out-of-sync detector.

Still further features involve the use of a load-sensitive declutching device for detecting motor overspeed which is demand-sensitive; that is, the overspeed limit will vary depending upon the load carried by the drum. Light loads will allow greater overspeed, for example, than will heavier loads.

Even if the out-of-sync detector is itself not used to generate the force to apply the brake but merely signals to another brake-actuating device, the benefit of a simple mechanical differential, out-of-sync detector provides a relatively inexpensive, low-maintenance, stand-alone detection device for energizing brake actuation in an emergency condition.

It should also be understood that while a total system and variations thereof will be illustrated and described, various components themselves are unique and have utility apart from a total system.

BRIEF DESCRIPTION OF THE DRAWINGS

FIG. 5 is a fragmentary section of an overspeed clutch forming a part of an embodiment of the invention.

FIG. 6 is a load-sensitive control for the over-speed clutch of FIG. 5.

FIG. 7 is a schematic elevation of another embodiment of brake-setting apparatus.

FIG. 8 is similar to FIG. 7 but illustrates a total mechanical brake-setting apparatus.

BEST MODE FOR CARRYING OUT THE INVENTION

Figure 1:
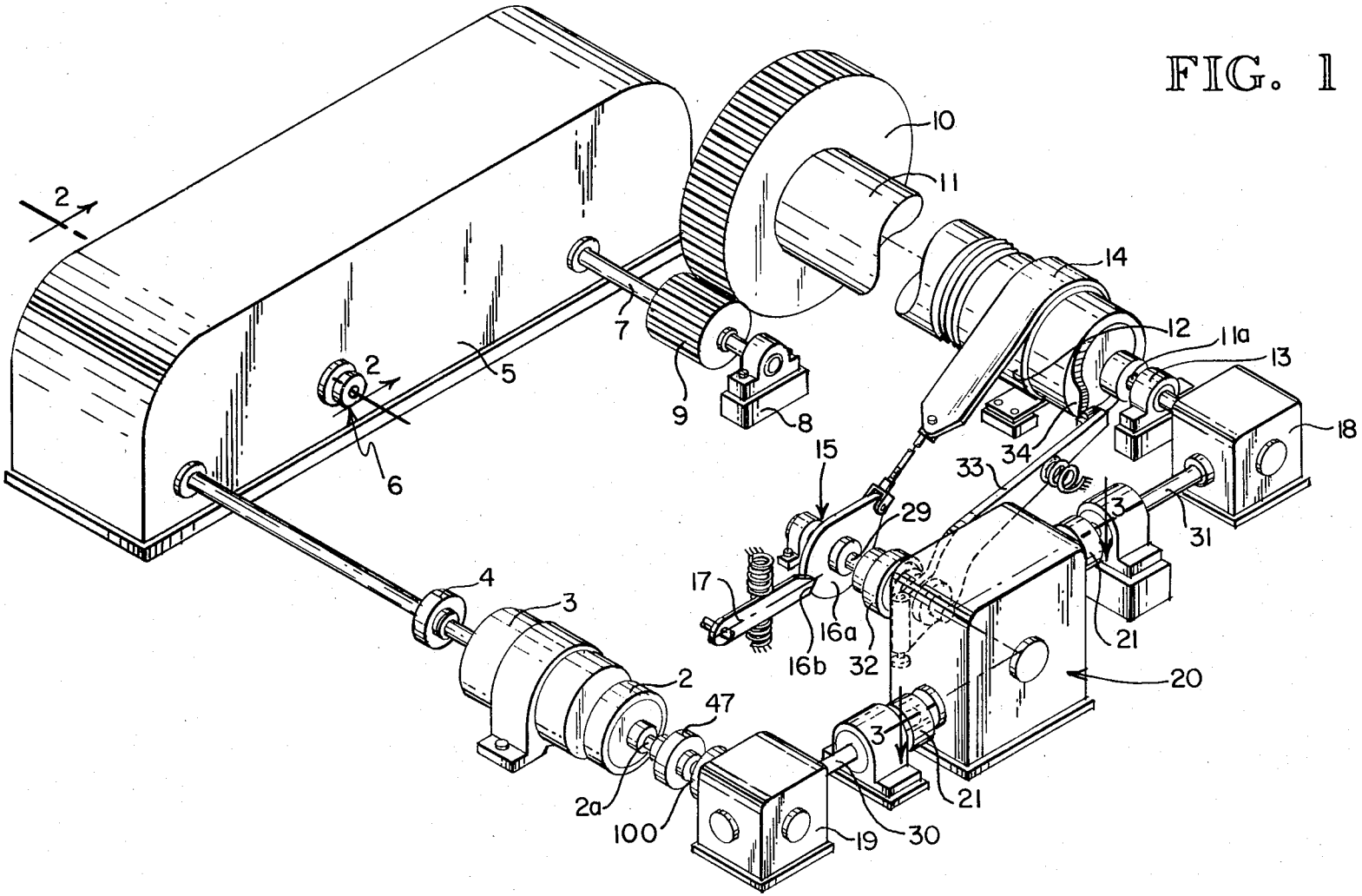
FIG. 1 is a schematic plan view of a hoisting mechanism employing the safety system of this invention.
Figure 2:
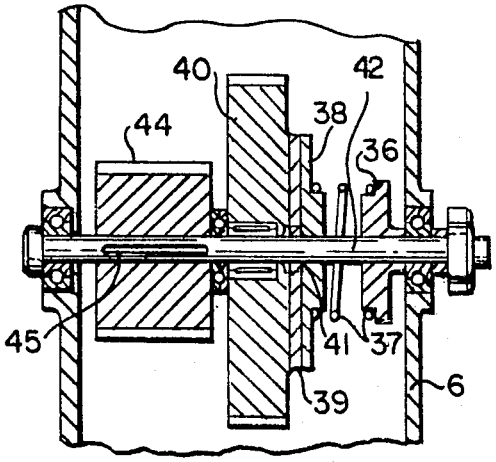
FIG. 2 is a section along the line 2—2 of FIG. 1.

As best shown in FIG. 1, a hoist system includes an operating brake 2 coupled to a motor shaft **2*a* which is powered by a motor 3. As is well understood by those skilled in this art, the operating brake 2 is hydraulically or, more commonly, electrically energized open (that is, to allow rotation of the motor shaft), and is hydraulically or electrically de-energized to be set to hold the motor shaft from rotating. Also, as is conventional, the operating brake will be set to hold the shaft, either when it is intentionally de-energized by a switch, when the hoist system is shut down, or when it is unintentionally de-energized, as in the case of a power failure. A coupling 4 couples the motor to a conventional gear reduction unit 5, such as a 500:1 reduction, which has an output shaft 7 rotatably carried in a pillow block 8. A drum pinion 9 meshes with the drum gear 10**.

Shaft 2a is generally considered the first high-speed load-carrying element of the system. This term is understood in the art as meaning the first or furthest element that carries the load such that if that element or any element between that first element and the drum failed, the load could be dropped. Similarly, there will be a last low-speed load-carrying element at the opposite end of the drive train driven from the drum. In the embodiment illustrated in FIG. 1, for example, this low-speed element is drum shaft 11a (to be described). Any drive component that fails in the drive train lower speed components adjacent the drum will be detected, because there will be a change in relative speed or direction between the first high-speed and last low-speed load-carrying elements.

A drum 11 is rotated by the drum gear on a shaft 11a which is rotatably supported in a pair of spaced pillow blocks 13. As described in earlier U.S. Pat. No. 4,175,727, a unique feature of the hoist system is that it is provided with a second brake, such as a band brake 14, wrapped on a brake drum 12. As will be described in more detail below, a brake-applying assembly or brake actuator 15 will set the brake in response to a detected failure or other hazard condition.

In the preferred embodiment of the invention, a torque limiter assembly 6 of the type shown in U.S. Pat. No. 4,175,727 is provided to limit the torque which would be imposed from high-speed rotational kinetic energy of the motor and high-speed drive elements of the gear reduction and motor drive if a load hang-up, overload or two-blocking occurs. It is to be understood that the inputs to the out-of-sync detector are to be coupled to the two most extreme load-supporting elements or points in the drive train.

It is a unique feature of this invention that a mechanical differential, out-of-sync detector 20 is provided for detecting the failure or hazard condition. In one embodiment, the detector also provides the mechanical force for applying the band brake 14. In preferred embodiments, the detector merely signals the out-of-sync detection and a separate brake actuator or brake-applying means sets the brake, as in FIGS. 7 and 8. The out-of-sync detector 20 includes an input shaft 30 which, in the embodiment illustrated, is coupled to the motor shaft 2a by a conventional right angle drive 19 having a gear reduction equivalent to that of the total gear reduction between the motor and the drum. A conventional right angle drive 18 also couples the drum shaft 11a to an input shaft 31 to the detector 20. The purpose of the gear reduction in right angle drive 19 is to bring the two input shafts entering the detector to approximately the same speed. Exact speed equality is desirable, but if suitable nulling is provided, as will be described, exact speed equality is not essential. Other forms of speed reduction can also be provided.

Figure 3:
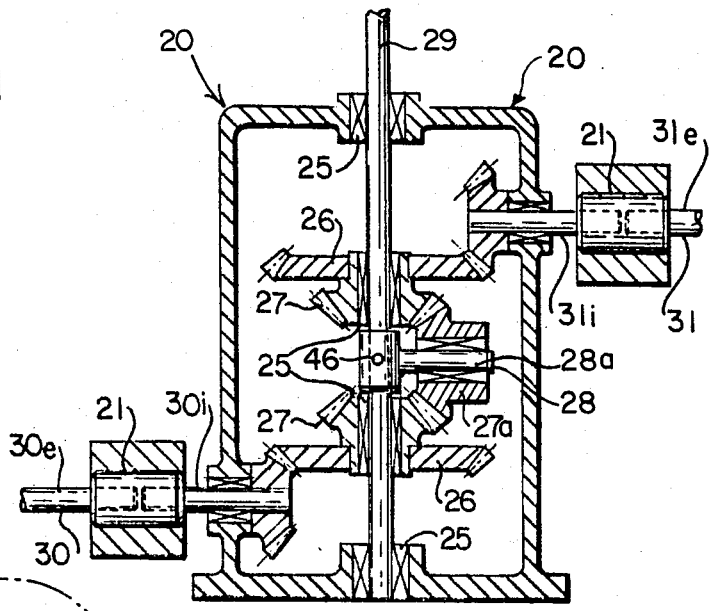
FIG. 3 is a fragmentary section take along line 3—3 of FIG. 1 of a differential detection system embodying the principles of the invention.
Figure 4:
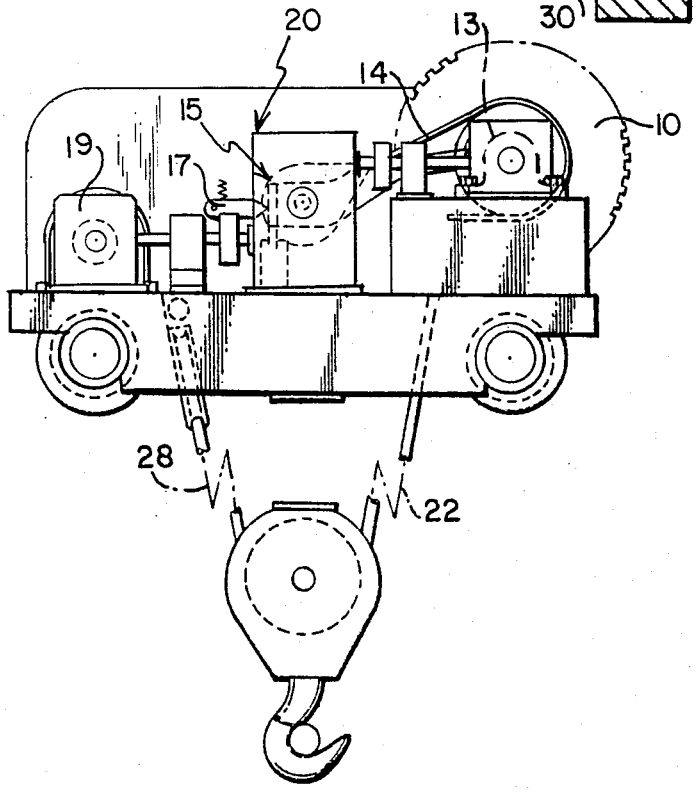
FIG. 4 is a side elevation of the hoisting device and safety system of FIG. 1.

Each of the input shafts 30,31, as is best shown in FIG. 3, is keyed to a drive gear which meshes with a side gear 26. The side gears 26 are keyed to pinion gears 27 that mesh with a planetary gear 27a of a planet carrier 28. As is well understood, equal and opposite rotational velocities of the drum input shaft 30 and motor input shaft 31 will cause the pinion gears 27 to rotate the gear 27a about a planet carrier post 28a that is fixed by a pin 46 to an output shaft 29 carried in bearings 25. Should the rotational velocity on either of the input shafts vary, an angular velocity will be created in the output shaft 29, the speed of which will depend on the relative variation between the velocities of the two input shafts. Thus, for example, if one of the input shafts should stop completely, the rotational output of the output shaft 29 will immediately reach a maximum speed. It is this rotation of the output shaft which triggers the brake actuation and, in one embodiment, creates or generates the force necessary for applying the brake on the brake drum 12. In this regard, while the preferred location for the brake is directly on the drum, it should be understood that it is also possible to place this brake on a downstream pinion shaft in close proximity to the drum rather than directly on the drum. The purpose of this brake is to apply a stopping force on the drum as close to the drum as is practicable so that no substantial risk occurs from a failure of some drive element between the brake and the drum. Furthermore, the input shaft 31 to the detector could also be from any location in the drive train between the motor and drum, which location is at the desired point to be monitored. Preferably, this location, however, will be at or close to the drum.

One form of brake actuator mechanism is shown as 15 in FIG. 1 and includes a lever 16a keyed to an extension 29a of shaft 29. The lever is coupled to the free end of the brake band 14 such that rotation of the lever 16a in either direction will set the band brake in a conventional manner. The lever 16a is provided with a notch 16b in which is inserted a spring-centered cog 17. A conventional clutch 32 couples shaft 29 to its extension 29a. A clutch throw out bar 33 follows a cam 34 on the drum to decouple the shaft extension 29a once each rotation of the drum. If the shaft 29 rotates through some predetermined maximum angle, as, for example, because of differences in the speed reductions between the motor and drum and the speed reductions between the motor and drum and detector 20 or because of creep in the drive train, lever 16a will rotate toward the maximum angle, but the clutch 32 will decouple the lever 16a before it rotates far enough for the cog to leave the notch 16b. Thus each time the clutch is decoupled at each complete revolution of the drum, the lever is returned to its centered position by the cog 17. In the event of a failure or load hang-up, etc., however, the shaft 29 will rotate at a high velocity and the drum will be stopped directly by the pull from lever 16a before one or perhaps at the most two more revolutions of the drum are possible.

It should also be understood that in those instances where there is an exact match between the drum, motor, and detector speed reductions and no torque-limiting device such as 6 which could cause creep, a nulling device such as clutch 32 is not necessary.

The details of a torque-limiting device (such as 6) are best described in U.S. Pat. No. 4,175,727, which is incorporated herein by reference thereto. The torque-limiting device 6 generally has a driven gear 40 which is driven by one of the upper stages of the gear reduction in the gear case 5. The gear 40 is provided with clutch facing 39 which is splined, as at 41, to a shaft 42. A spring 37 pushes a pressure plate 38 against the clutch facing, thus releasably holding the gear 40 in driving engagement with the shaft 42. A pinion gear 44 is fixed to the shaft 42 by a key 45. As is well understood, by adjusting the position of the spring holder 36, a desired torque can be carried between the clutch facing and the driven gear 40. If an overload occurs, such as by excessive load, load hang-up, two-blocking, a jamming in the drive train, or the like, the high-speed kinetic energy upstream of the driven gear 50 will be dissipated as heat in the clutch facing and the downstream drive components from pinion gear 44 to the drum will be stopped. Because of this safety feature of the torque-limiting device, however, there may be a certain minimum amount of creep or relative rotational movement between the gear 40 and the shaft 36 so that there may be slight variations between the input shaft 30 and the drum input shaft 31 in the differential detector 20, as earlier described.

In the preferred embodiment, a centrifugal clutch 47 (FIG. 5) is provided to decouple input shaft 30 from motor shaft 2*a* when the motor shaft rotates at an overspeed above some predetermined percentage of its normal driven speed. That is, if some failure occurs which causes the motor to rotate beyond its set speed, the shaft 30 will become decoupled and stop, thus providing a variation between the relative velocities of shaft 30 and shaft 31 to provide a rotational output to output shaft 29 and set the brake. It is important in the differential assembly that the differential not back drive the input shafts, and thus, in a preferred embodiment, there are provided drag mechanisms on each of the input shafts to assure that the output shaft is rotated when one of the input shafts changes its velocity relative to the other to provide a variation between the relative velocities of the input shafts. Continuous friction drags could be provided on each of the shafts for this purpose, or the inputs could be through worm gear drives; but in the preferred embodiment, the shafts are broken into two sections, namely, an external section 31*e* and an internal section 31*i* and an external section 30*e* and an internal section 30*i*. The internal and external sections of each shaft are joined by a conventional one-way drag clutch or "NO BAK" clutching device 21 of the type manufactured by Ann Arbor Bearing and Manufacturing Company, Ann Arbor, Mich. These types of devices are well known, and in the invention here described, are uniquely positioned so that the external section 30*e*, when driving in either direction, will freely rotate the internal section 30*i*. Likewise, the clutch on the drum input shaft is positioned so that when external section 31*e* is providing a driving input, the internal section 31*i* will freely rotate. The converse is not true, however. That is, if at any time, one of the internal sections tries to drive the external section of that input shaft, the clutch will lock up so that the internal section cannot rotate. This provides a unique and more positive clutching or drag device for the input shafts to assure that when there is a change in velocity relative to the other input shaft, this change cannot be transmitted backwards to rotation of the other input shaft, but rather must be converted immediately and in all cases to a rotational output of the output shaft 29.

An overspeed clutch 47 is provided in a preferred embodiment. Any type of conventional overspeed device can be employed, but it is an advantageous feature of one embodiment of this invention to employ a mechanical clutch having a clutch friction plate 48 keyed to shaft 2*a* and an opposed friction and pressure plate 49 keyed to a separate stub shaft 50 which drives the right angle gear box 19. A spring 52 is compressed by centrifugal governor weights 54 to hold the friction plates in driving engagement. When shaft 2*a* rotates rapidly, as in an overspeed condition, the weights 54 swing outwardly and spring 52 is released, thereby allowing plates 48 and 49 to slip relative to one another. Once shaft 50 is released from shaft 2*a*, the detector signals the out-of-sync condition and the brake 14 is set.

Control systems for high-performance hoists are sometimes designed to sense the lifted load and to command motor 3 to operate at higher than full-load rated speed when handling a lighter load. This may be as high as 300 percent when operating under such no-load condition. Conventional overspeed drives are generally set in this no-load case to cut out at more than 300 percent full-load speed. This reduces the safety when handling a full load.

Thus, if desired, the clutch 47 can also be made load-sensitive. To release the friction discs 48 and 49 sooner or at a lower speed, a bell crank 56 is threaded in a nut 58 such that when screwed away from spring 52, the weights 54 will have less pressure on them and will open to release the discs 48 and 49 sooner or at a lower overspeed. If the bell crank is screwed in the opposite direction, higher overspeed can occur before the clutch plates are separated.

Motion of the bell crank 56 is provided by a line 60 coupled to a pivoted arm 62 that is balanced by a calibrated spring 64. The drum line 70 is reaved about a traveling block 72 and thence to a sheave 73 on arm 62. As the load is increased, arm 62 is lowered, thus moving bell crank 56.

While the detector 20 can signal an electrical shutoff or brake-setting device, it advantageously preferably signals or triggers a mechanical brake actuator. In the embodiment of FIG. 1, the detector can itself apply the brake. Two forms of triggering devices for setting the brake 14 are illustrated in FIGS. 7 and 8. It is common to both these triggering devices that a large spring force can be applied to set the brake, but a small trigger release force is all that is necessary to release the spring. This allows an inexpensive, trouble-free, manual or powered reset mechanism to again set the large spring force using a slower but highly leveraged resetting force.

In FIG. 7, the brake band 14 is set by a spring 74 having a large spring force, as is necessary for high-load capacity drums. A lever 75 is engaged by a trigger 76 which holds the spring in a cocked position. The trigger 76 is anchored or locked by a conventional trigger release cam 78. A solenoid 80 having an extendible arm 81 pivotally mounts one end of the cam 78. The cam is also pivoted at 83 and has an end 84 that abuts the trigger 76. A spring 89 urges the cam 78 into the phantom-line position to disengage from the trigger 76. When solenoid 80 is energized, the trigger release cam is in the solid-line position. The solenoid will be de-energized to set the brake when lever 16*a* moves sufficiently to signal a failure condition. In this embodiment, the electrical signal to de-energize the solenoid 80 can be by any conventional electrical switch actuated by the lever 16*a*. Thus it is apparent that the small, easily controlled spring 89 is all that must be overcome to hold the large spring 74 in the cocked position.

To reset the trigger and spring 74, a relatively slow-speed rotary screw drive 90 moves the trigger, solenoid, and trigger release to the left. The trigger strikes a cam 92 that rotates the trigger counterclockwise, and the solenoid is energized to again hold the trigger in the cocked position. Movement of the screw to shift the trigger to the right then reengages the lever 75 and recompresses the spring 74. Since the spring can be compressed slowly, the highly leveraged screw drive is easily able to overcome very large spring forces.

FIG. 8 illustrates a mechanical trigger release. In this embodiment, the crane can be electrically de-energized without having to set the brake 14, which is a disadvantage in the embodiment of FIG. 7. In this preferred embodiment, the lever 16*a* (FIG. 1), rather than being coupled directly to the brake band 14, is coupled to an elongated cable 94 that is connected to the trigger release cam 78 by a lost-motion slot 95. As the lever 16*a* rotates in an out-of-sync condition, the cable 94 is pulled, pivoting trigger release cam 78 into the phantom-line position to release trigger 76 in the same manner as in FIG. 7. Resetting of the spring 74, trigger 76, and cam 78 is similar to the above description of FIG. 7.

Figure 3A:
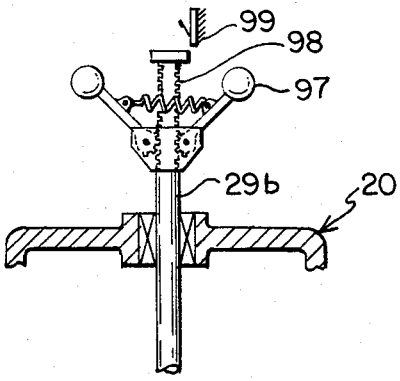
FIG. 3A is a schematic fragementary section of another embodiment of detection device employed in one form of safety system.

FIG. 3A illustrates a schematic modification of the detector 20 capable of providing a signal for setting a brake actuator. In this embodiment, the detector output shaft 29 is provided with a flyball governor 97 that meshes with a rack 98 slidably mounted in the shaft 29*b*. As the ball levers swing out from an out-of-sync condition, teeth on the levers meshing with the rack extend the rack. The rack engages a normally closed switch 99 to open the switch and de-energize solenoid 80, for example, to set the brake. The structure of FIG. 3A is in essence an electromechanical replacement for the structure 15 of FIG. 1. FIGS. 7 and 8 are each alternative systems. FIG. 7 uses the centrifugal electric switch operator of FIG. 3A described hereafter.

If desired, a normally energized electric clutch 100 can be added to any of the embodiments to decouple the motor shaft from the detector for setting the brake automatically if an electrical power failure occurs. Furthermore, this clutch or the overspeed clutch could also be placed on the drum side of the input to the differential detector.

The operation of the various embodiments of the safety system will now be described. During normal operation, such as with the motor shaft 2*a* being rotated at approximately 1200 rpm, the drum speed will be reduced to approximately 2.4 rpm at the drum shaft 11*a*. The motor shaft at its 1200 rpm is then coupled through the centrifugal clutch 47 and right angle/gear reducer drive 19 to the differential detector assembly 20 via the input shaft 30. Similarly, the 2.4 rpm rotation of the drum shaft is coupled via right angle drive 18 to provide the same rpm input to the input shaft 31. It should be understood that these gear reductions do not have to be exact so long as they are proportionate, and the gear reduction, which is approximately 2:1 within the differential drive assembly, is sized accordingly. The desired result is that shaft 31 and shaft 30, when the hoist is operating either in the lowering or hoisting mode, provide substantially the same angular velocities to the differential gear 27*a* so that output shaft 29 rotates not at all or perhaps rotates one way or another at a very low rate, depending on the amount of slippage, variance in gear reductions, or creep in the system. If there is an overload, a load hang-up, a two-blocking or any failure in a drive component such that the drum tries to stop, the torque-limiting device, if provided, will dissipate the high-speed kinetic energy in the motor and upstream drive components, and the input shaft 31 will slow down or stop immediately, thus providing a variation between the angular velocities of the input shaft 31 and the input shaft 30. The motor input shaft will then cause the output shaft 29 to rotate rapidly; for example, at about 600 rpm., since no slippage or back rotation can occur due to the clutch or drag 21 on the drum input shaft. Rotation of the output shaft 29 will immediately rotate the ball governor 97 or rotate the lever 16*a*, and the force applied by this rotation will be used either as a signaling device, as in FIGS. 7 and 8, to set the brake, or, in a totally mechanical system, as in FIG. 1, to directly tighten the band brake. Should the motor shaft 2*a* rotate above its rated speed, such as where the controller may fail and allow the motor to drive the hoist too rapidly, the clutch 47 will disengage the motor shaft from the detector, stopping the input shaft 30 and providing an out-of-sync rotation of shaft 29. Similarly, if either the input shaft 30 or the input shaft 31 of the differential assembly should fail or any component in these inputs to the differential assembly should fail, the shaft 29 again will be rotated to set the brake. There is in essence no type of single failure that is not detected and the brake actuated, resulting in an extremely safe, relatively inexpensive detection and brake-actuating system for the hoist mechanism. Furthermore, any combination of overspeed and electrical clutches, as described, can be used with the detector, depending upon the requirements for a particular hoist.

While the preferred embodiments of the invention have been illustrated and described, it should be understood that variations will be apparent to one skilled in the art without departing from the principles herein. Accordingly, the invention is not to be limited to the specific embodiment illustrated in the drawing.

I claim:

1. A safety system for a load-carrying hoist comprising:

a primary drive train including an input motor means, said primary drive train having a first high-speed load-carrying element, a drum operatively connected to an output end of said primary drive train, a last low-speed load-carrying element operatively associated with said drum, an operating brake operatively associated with the motor to hold the load when the motor is de-energized, and an emergency brake operatively coupled to the drum;

a mechanical out-of-sync detector;

brake-applying means responsive to an output from the out-of-sync detector for applying said brake;

said detector including a mechanical differential assembly having a first input element drivingly coupled to the first high-speed load-supporting element, a second input element drivingly coupled to the last low-speed load-supporting element of the hoist, an out-of-sync detection output element, differential means coupled to said first and second input elements and operable upon relative angular velocity differences between said input elements to rotate said output element due to an out-of-sync condition, including means for restricting movement of said input elements when attempted to be driven by said differential means, whereby neither input element is back-driven by said differential means and thus the output element is caused to rotate during differential angular velocities between said input elements; and means operatively coupling the detector output element to said brake-applying means for applying the brake in said out-of-sync condition.

2. The system of claim 1, said brake-applying means including force-applying means for tightening the brake, and the rotational output of said output element caused by said differential angular velocities of said input elements providing the force for moving said force-applying means for tightening the brake.

3. The safety system of claim 1 wherein said differential means includes a differential gear drivingly coupled to the input and output elements for rotating the output element when the input elements have a relative change in velocity.

4. The safety system of claim 1, said means for restricting movement of said input elements including said first and second input elements having shafts each having external and internal shaft sections each joined by a unidirectional drive clutch which transmits rotation into the differential means but does not transmit rotation if driven from the differential means, said internal shaft sections being coupled to said differential means and each said unidirectional drive clutch being operative to transfer rotational drive inputs from said external shaft sections but preventing rotation of said internal shaft sections when internal shaft sections attempt to drive said external shaft sections.

5. The system of claim 1, said gear reduction unit including torque-limiting transfer means operable to allow slippage to limit torque applied between the motor and the drum for dissipating kinetic energy of the motor and primary drive train in case of a hazard condition of the type precluding upward movement of the load, and wherein said slippage causes a normal minor relative angular velocity difference between said first and second input elements to rotate said differential means output element.

6. The system of claim 5, said first and second input elements having said normal minor and hazard abnormal major relative angular velocity differences and including nulling means for maintaining the output element in an in-sync condition to compensate for said minor relative angular velocity differences between said input elements.

7. The system of claim 6, said output element including a shaft having inner and outer ends, said nulling means including a disconnect clutch on said output element operable to disconnect the output shaft outer end from said output shaft inner end, means for centering said outer end of said output shaft when disconnected from said inner end, and means responsive to rotation of said drum for periodically disconnecting said clutch.

8. The system of claim 1, further including an overspeed detection clutch for disconnecting one of said input elements during an excessive threshold overspeed condition to initiate said relative angular velocity difference between said first and second input elements.

9. The safety system of claim 8, further including load magnitude responsive means to correlate load magnitude to motor speed for varying the threshold excessive overspeed condition dependent upon load magnitude.

10. The safety system of claim 9, said load magnitude correlation means including an adjustable speed governor on said overspeed detection clutch, and load magnitude-sensing means coupled to said load and said adjustable speed governor for adjusting the governor movement with load magnitude.

11. The system of claim 1, further including an electrically activated driving clutch operable when electrically de-energized to disconnect an input element from its respective motor or drum to initiate said relative angular velocity differential between said first and second input elements.

12. The system of claim 1, said brake-applying means including a high-force, brake-setting spring and a low-force anchor releasibly holding said spring in a cocked condition, means responsive to a hazard condition for moving said low-force anchor to release said high-force spring for setting said emergency brake, and means for restoring said spring and low-force anchor to their initial cocked condition and releasing said emergency brake.

13. A safety system in a hoist having a reversible electric input motor, a primary drive train including a gear reduction unit drivingly connected to the input motor, a drum drivingly connected to the gear reduction unit, and an emergency brake operatively coupled to the drum, comprising:

a mechanical out-of-sync detector having an output member and first and second input members, means coupling the first input member to the primary drive train, and means coupling the second input member to the drum, said reversible input motor causing each of said input members to rotate multidirectionally and simultaneously in all normal raising and lowering operating modes of said hoist, said output member moving upon an out-of-sync condition between said input members; and a spring-set brake including spring means for setting the brake, mechanical trigger means for holding the brake against the brake-setting force of the spring means and releasing the spring means for setting the brake responsive to said motion of the output member, and mechanical link means coupled to the output member so that upon said movement of the output member of the detector, the motion is transmitted via the mechanical link means to release the trigger means and allow the spring to set the brake.

14. The safety system of claim 13 wherein the detector is a differential assembly that includes first input shaft means coupled through a drag clutch to the motor of the hoist system and second input shaft means coupled through a drag clutch to the drum shaft of the hoist device, and wherein there is a differential gear set coupled to both of said input shaft means between the drag clutches thereon and having an output shaft coupled to the differential gear set wherein a difference between the relative velocities or directions of the respected input shaft means will produce movement of the output shaft, and means coupling the output shaft to the brake actuator for converting this movement to a force for applying the brake.

15. The safety system of claim 14 wherein said drag clutches each include a one-way clutch, with the first and second shaft means into the differential assembly each having respective external and internal sections, the one-way clutches allowing driving rotation between the external and internal sections when the external sections are driving but preventing rotation of the internal sections when one of the internal sections tries to drive an external section, thereby causing a relative angular velocity change in the input shaft means and a resultant movement of the output shaft.

16. A safety system in a hoist having a primary drive train comprising an input motor on the high-speed end of the primary drive train and a gear reduction unit drivingly connected to the motor, a drum drivingly connected to the gear reduction unit, a normal operating brake, and an emergency brake operatively coupled to the drum, comprising:

a mechanical out-of-sync detector;

said normal operating brake being located on the high-speed end of the primary drive train, said detector including a mechanical differential assembly having a first input element operatively coupled to said motor, a second input element drivingly coupled to said drum, an overspeed release clutch, which disconnects when rotated above a predetermined rotational speed, drivingly connected between one of said input elements and its respective motor or drum, an output element, differential means coupled to said first and second input elements and operable upon relative angular velocity changes between said input elements, including a relative velocity change caused by disconnection of the overspeed release clutch, to rotate said output element in an out-of-sync condition; and brake-applying means responsive to said detector for applying only said emergency brake.

17. The safety system of claim 16, in which each of the input elements includes an input shaft which has an external and an internal section coupled by a one-way clutch, said one-way clutches each being positioned such that the external input shaft section can drive the internal section but an internal section cannot drive an external section, whereby a rotational input from one of the first or second input shafts while the other is stopped will immediately result in said differential means producing rotation of the output element to set the brake.

18. The safety system of claim 16, in which the detecting means and brake-applying means are coupled to the output element such that the detecting means provides the force for directly setting the brake.

19. A safety system in a hoist having an input motor, a primary drive train unit drivingly connected to the motor, a drum drivingly connected to the primary drive train unit, a normal operating brake and an emergency brake on an operating element drivingly coupled to the drum, comprising:

a mechanical out-of-sync detector;

brake-applying means responsive to an output from the out-of-sync detector for applying said emergency brake;

said detector including a mechanical differential assembly having a first input element drivingly coupled to said motor, a second input element drivingly coupled to said drum, an output shaft, differential means coupled to said first and second input elements and operable upon relative angular velocity differences in either rotational direction between said input elements to rotate said output element in an out-of-sync condition;

said primary drive train including torque-limiting transfer means operable to allow major slippage to limit torque applied between the motor and the drum for dissipating kinetic energy of the motor and primary drive train in case of a hazard condition of the type precluding upward movement of the load but causing minor slippage during normal operation, and wherein said major and minor slippage causes a relative major and minor change in angular velocity of said first and second input elements to rotate said differential output element;

including nulling means for maintaining the output element in an in-sync condition to compensate for such minor relative angular velocity differences between said input elements; and said brake-applying means being responsive to such output element rotation for applying the brake in said out-of-sync condition, said brake-applying means including a high-force spring held in a cocked condition and, when released, capable of applying a high braking force, a trigger mechanism holding said spring in said cocked condition, a low-force trigger release mechanism for holding said trigger in said cocking condition, and means for releasing said low-force trigger release mechanism to release said trigger mechanism to thereby release said spring to set the brake, and reset means for resetting the low-force trigger release mechanism and triggering mechanism to recock said spring and thus reset said brake.

20. The system of claim 19, said trigger release mechanism including a solenoid, a carrier for holding the trigger mechanism against the spring and a high-force motiontransmitting device for linearly translating said triggering mechanism to cock said spring.

21. A safety system for a hoist of the type having an input motor, a primary drive train, a drum, and a brake coupled to the drum or to an element drivingly coupled to the drum, comprising:

said primary drive train including an input motor means, said primary drive train having a first high-speed load-carrying element, a drum operatively connected to an output end of said primary drive train, a last low-speed load-carrying element operatively associated with said drum, an operating brake operatively associated with the motor to hold the load when the motor is de-energized, and an emergency brake operatively coupled to the drum;

means for detecting a hazard condition, such as an operating brake failure, including first and second input elements drivingly coupled to the first high-speed and last low-speed load-carrying elements of the hoist, an output element that moves when a differential rotation occurs between said input elements, an electric clutch which, when electrically energized, drivingly couples one of said input elements with its respective load-carrying element and being inoperative upon being electrically de-energized to decouple the input element from its respective load-carrying element; and brake-applying means for applying the brake responsive to motion of said output element of said detecting means when said electric clutch is de-energized and said operating brake fails.

22. The system of claim 21, emergency brake-applying means including a large force spring, which, when released, will set the emergency brake, low-force triggering means for holding the large-force spring in cocked condition, and low-force trigger release means for releasibly holding the trigger means, whereby a low force can cause release of the high-force spring to set the emergency brake, said low-force trigger release means including a trigger reset mechanism operable to engage the trigger means for holding the spring and recocking the large-force spring.

23. The system of claim 21, said low-force trigger release means including a solenoid release wherein actuation of the solenoid moves the trigger release to release the trigger means and releases the large-force spring.

24. The system of claim 23, said low-force trigger release means including a trigger reset mechanism operable to engage the trigger means for holding the large-force spring and recocking the large-force spring.

25. The system of claim 21, said primary drive train including torque-limiting transfer means automatically operable to allow major slippage in the event of excessive torque between the motor and the drum for dissipating the kinetic energy of the motor and primary drive train in case of a hazard condition of the type precluding upward movement of the load, said torque-limiting transfer means causing minor slippage during normal operating conditions, and wherein either slippage causes a relative differential angular velocity of said first and second input elements to rotate said differential output element, and including nulling means for maintaining the output element in an in-sync condition by compensating for said minor relative angular velocity differences between said input elements but allowing the output element to respond to said major slippage.

26. The safety system of claim 13 wherein the emergency brake is a band brake having fixed and movable ends and said mechanical link means is coupled directly to the movable end of the band brake for setting the brake.

27. The safety system of claim 13 wherein the emergency brake is spring applied and held unset by a trigger mechanism and wherein said mechanical link means is coupled to said trigger mechanism for releasing the trigger to apply the brake.

28. The safety system of claim 16, said overspeed release clutch being located between the first input element and the motor.

29. A safety system in a load-carrying hoist in which there is defined a last upstream load-carrying component and a last downstream load-carrying component and in input motor with a motor shaft, a power transmission main drive operatively coupled to the motor, an operating brake operatively associated with the motor to hold the load when the motor is de-energized, a drum and an emergency safety brake drivingly coupled to an operating element closely associated with this drum but independent of the main drive so as to provide emergency holding of the load in the event of a main drive failure, a safety brake actuator responsive to an output from an out-of-sync detector for applying said safety brake, a mechanical out-of-sync detector, said detector including a monitoring secondary drive train having a first input shaft drivingly coupled to the last upstream load-carrying component, a second input shaft drivingly coupled to the last downstream load-carrying component, means for detecting a predetermined variation in relative speed or direction between said two input shafts and producing an emergency brake-setting rotation output to set said emergency safety brake, said power transmission main drive having minor slippage producing an accumulative error between the relative rotations of the last upstream and last downstream load-carrying components, and error compensating means for compensating for such relative rotation accumulative error so that an emergency brake-setting rotation output does not occur from said accumulative error.

* * * * *